United States Patent [19]

Goekler

[11] Patent Number: 4,500,570

[45] Date of Patent: Feb. 19, 1985

[54] PIPELINE PRIMING METHOD AND SYSTEM

[75] Inventor: Robert G. Goekler, London, England

[73] Assignee: Crutcher Resources Corporation, Houston, Tex.

[21] Appl. No.: 185,285

[22] Filed: Sep. 8, 1980

Related U.S. Application Data

[63] Continuation of Ser. No. 949,860, Oct. 10, 1978, abandoned, which is a continuation of Ser. No. 795,207, May 9, 1977, abandoned.

[51] Int. Cl.[3] ..... B05D 1/28; B05D 1/30

[52] U.S. Cl. ..... 427/345; 427/355; 427/368; 427/434.2; 427/434.7; 427/377; 118/65; 118/108; 118/404; 118/DIG. 19

[58] Field of Search ..... 427/355, 368, 434.2, 427/434.7, 345, 377; 118/64, 65, 108, 125, 404, DIG. 19

[56] References Cited

U.S. PATENT DOCUMENTS

| | | | |
|---|---|---|---|
| 348,535 | 8/1886 | Rosenblatt | 118/108 |
| 1,368,816 | 2/1921 | McNulty | 118/108 |
| 1,375,979 | 4/1921 | Taber | 118/108 |
| 1,867,476 | 7/1932 | Rogers | 118/404 |
| 2,034,755 | 3/1936 | Fuller | 118/400 X |
| 2,112,825 | 4/1938 | Converse et al. | 118/404 X |
| 2,166,249 | 7/1939 | Herman | 118/65 |
| 2,193,971 | 3/1940 | Laurent | 118/108 |
| 2,216,519 | 10/1940 | Quarnstrom | 118/DIG. 11 X |
| 2,340,325 | 2/1944 | Harrigan | 118/404 |
| 2,867,188 | 1/1959 | Kuxhaus | 118/108 |
| 3,374,766 | 3/1968 | Weaver et al. | 118/125 X |
| 3,690,294 | 9/1972 | Harper | 118/125 X |

*Primary Examiner*—Shrive P. Beck

*Attorney, Agent, or Firm*—Richards, Harris & Medlock

[57] ABSTRACT

Apparatus for applying a primer paint coating onto a pipe wherein a structure movable along the pipe forms an enclosed annular cavity about the pipe. Primer paint fills the cavity and wets the complete circumference of the pipe. The cavity is filled by means of gravity flow with the surplus primer being collected in a reservoir and pumped back to the top of the cavity. Means are provided to wipe the primer to a predetermined thickness and returns the surplus to the reservoir. A gas rich environment surrounds the paint filled cavity and wiper means.

10 Claims, 4 Drawing Figures

PIPELINE PRIMING METHOD AND SYSTEM

This is a continuation of application Ser. No. 949,860 filed Oct. 10, 1978 now abandoned, which is a continuation of application Ser. No. 795,207 filed May 9, 1977, now abandoned.

FIELD OF THE INVENTION

This invention relates to pipe line installations and more particularly to a system for continuously applying a primer coat to a pipe onto which a protective tape is to be wrapped. In a more specific aspect the invention relates to a wetting/wiping system which applies a continuous thin coat of a primer material onto the surface prior to wrapping the surface with a tape.

DESCRIPTION OF THE PRIOR ART

Heretofore, machines have been provided which are mounted to travel along the length of a pipe which is to be cleaned, primed and tape wrapped. Representative of such machines is the machine manufactured and sold by C. R. C. Crose International Inc. of Houston, Tex., and identified as the combination cleaning, priming, tape wrapping machine Model CPT 48-56. In this machine, a set of counter rotating heads carry brushes which apply cleaning action to the surface of a pipe that is to be primed and wrapped with tape. Immediately trailing the cleaning heads is a spray system which applies a primer coat to the freshly cleaned surface of the pipe.

The application of the priming coat is then followed by the application of a tape which is wrapped onto the surface to provide insulation and protection for the pipe line as is well known.

Primers that have been found to be most suitable for this purpose are highly volatile. With such great flammability, fires have been experienced which are most difficult to control and in some cases have resulted in complete destruction of the system by fire occasioned by the concentration of a volatile, flammable atmosphere in and around the pipe immediately downstream of the cleaning unit. In order to minimize the probability of fire in such systems the above-identified machine, CPT 48-56, has been provided with an exhaust fan to drive from the spray site any combustible atmosphere that might otherwise accumulate.

The present invention is directed towards eliminating the problem occasioned by the spray application of the primer coat. The present invention is directed to the application of a primer coat which is wiped onto the surface of the pipe in a manner which eliminates the fire hazard.

SUMMARY OF THE INVENTION

In accordance with the present invention a pipe treating machine is provided wherein a tape is to be wrapped onto the pipe for protection thereof. The present invention is directed to a system for applying the primer coating to the pipe. The system involves structure movable along the pipe and includes a pair of coaxial annular spreader units spaced apart along the pipe and forming a closed annular cavity which encircles the pipe. Means are provided for gravity loading of a liquid primer into the cavity thereby to wet the entire surface of the pipe between the spreader units. Means including a wiper unit fairly tightly clamped to the pipe in trailing relation to the cavity also forms an annular enclosure around the pipe but outside of the cavity. A reclamation reservoir then receives flow of surplus primer paint that is wiped from the pipe by the wiper unit. A pump then serves to deliver the surplus primer reaching the reclamation reservoir for delivery back into the cavity.

DESCRIPTION OF THE PREFERRED EMBODIMENTS

Figure 1:
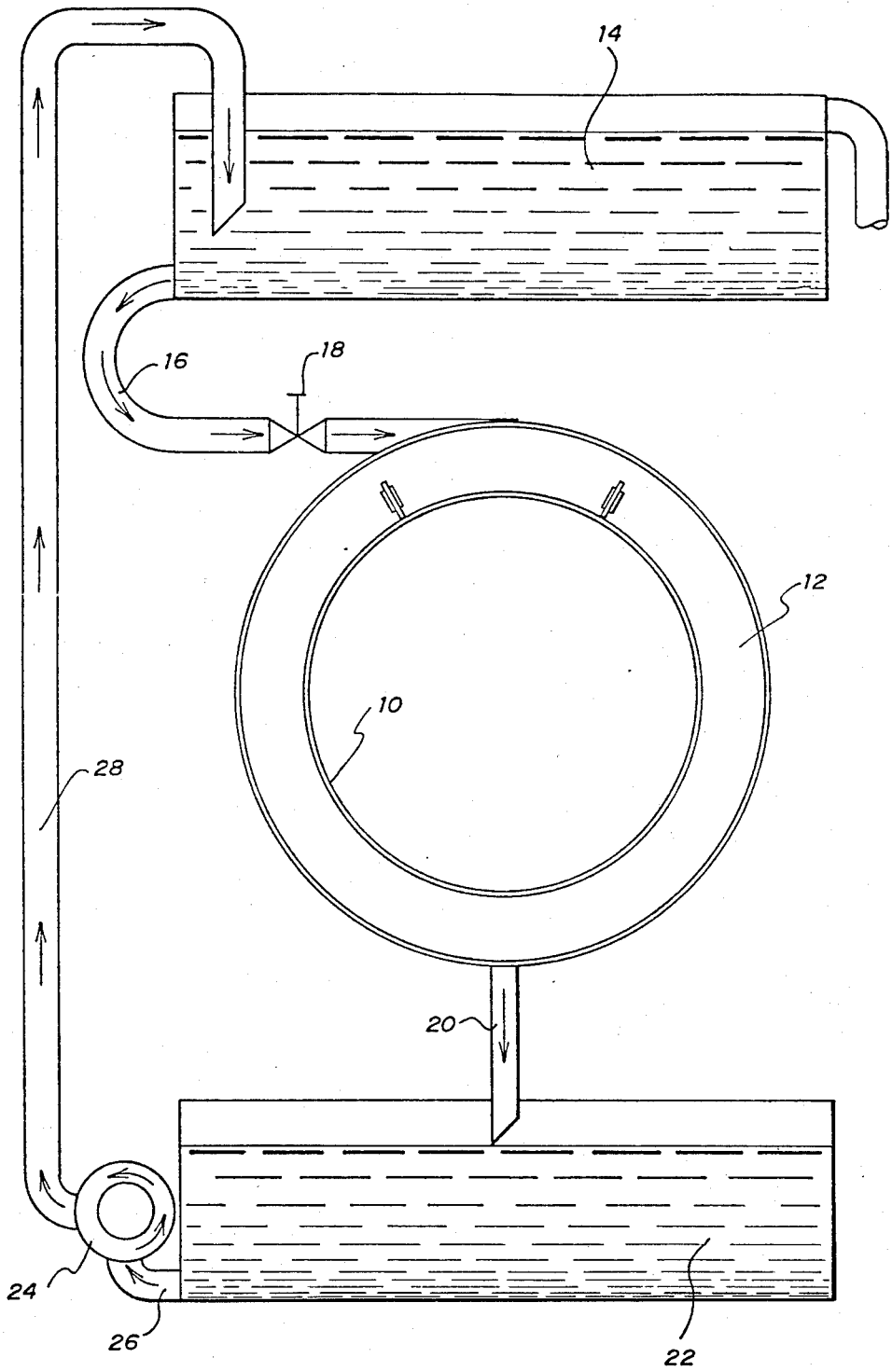
FIG. 1 is a diagramatic view of a system embodying the present invention.

Referring now to FIG. 1, a pipeline 10 is shown in sectional view surrounded by a flood shoe 12. The flood shoe 12 comprises structure which forms an annular cavity of fairly short length completely surrounding the pipeline 10. The cavity is adapted to receive flow of a primer fluid from a surge tank 14 by way of a conduit 16 and a valve 18. The surge tank 14 is maintained with an adequate supply of the primer fluid so that the fluid will flow by gravity into the flood shoe 12 such that the entire surface of the pipeline 10 is wetted by the primer material. Return line 20 extends from the flood shoe structure to a reclamation tank 22. A pump 24 having an inlet line 26 at the bottom of the reclamation tank 22 then delivers any surplus liquid from the reclamation tank 22 to the surge tank 14 by way of a return line 28.

Figure 2:
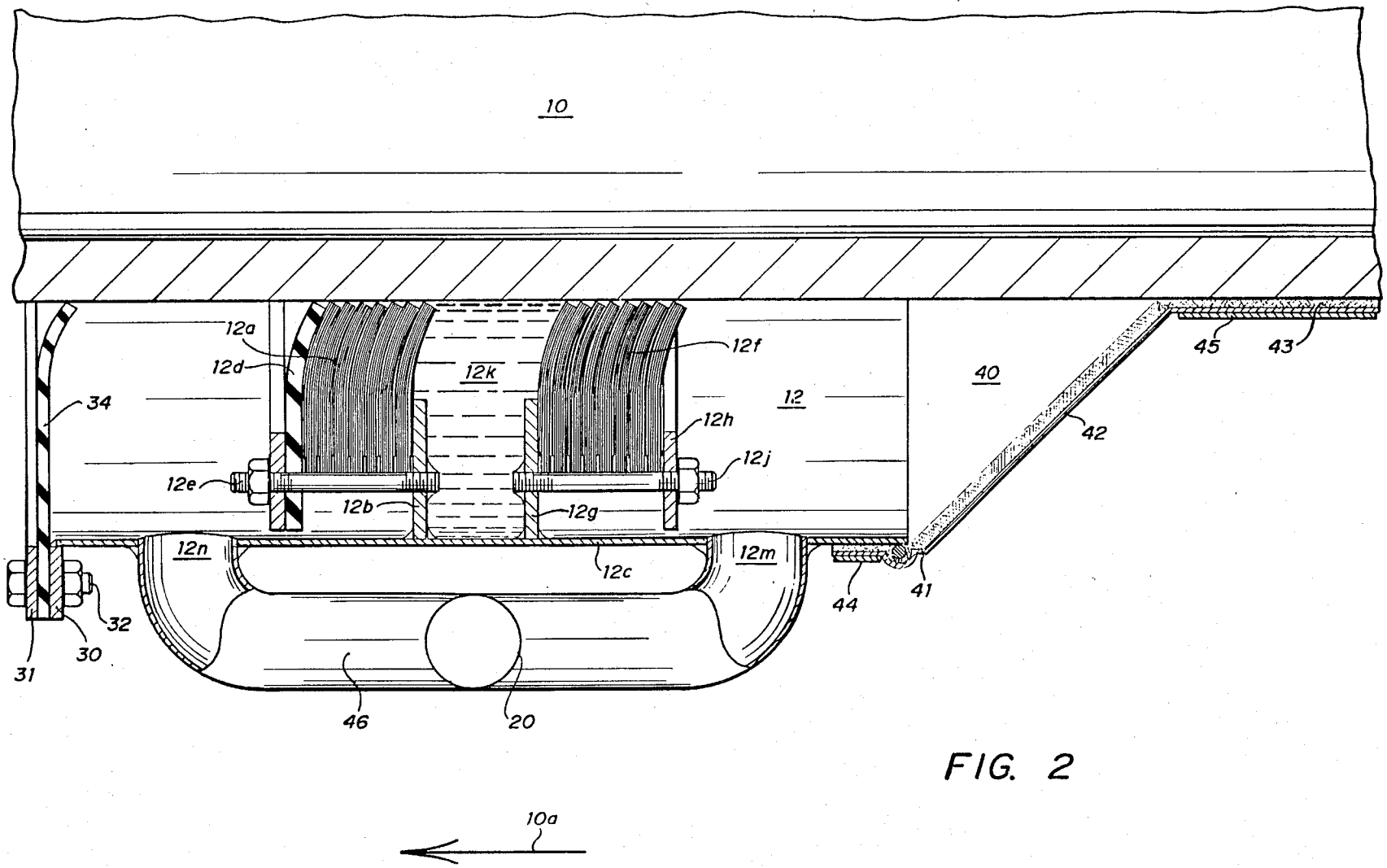
FIG. 2 is an enlarged sectional view taken along a vertical plane which includes the horizontal axis of the pipeline.

Referring now to FIG. 2, it will be seen that the flood shoe is comprised of two sets of fiber brushes. The first set of brushes **12*a* are mounted on one side of a large diameter flat ring 12*b*. The periphery of the ring 12*b* is welded to the inner surface of a relatively short cylinder 12*c* which encircles the pipe line 10. A rubber washer 12*d* is placed immediately ahead of the stack of brushes 12*a*. The washer 12*d* and the brushes 12*a* are clamped and held in position by a bolt 12*e* which is secured to the ring 12*b*. Thus, the rubber washer 12*d* and the brushes 12*a* form a lead wiper portion of the flood shoe 12. A trailing wiper is formed by a series of brushes 12*f* that are clamped between the surface of ring 12*g* and washer 12*h* mounted on a bolt 12*j***.

The brushes **12*a* and 12*f* are spaced apart longitudinally along the length of the pipeline to form a cavity 12*k* into which the primer fluid is placed. The unit is mounted with the cleaning and taping components of the system for movement in the direction of arrow 10*a* so that the brush set 12*a* leads the brush set 12*f*. With the surface of the pipeline 10 being completely wetted over the entire circumference as defined by the cavity 12*k*, the primer material will be wiped on and intimately adhered to the surface of the pipeline 10 by the trailing brushes 12*f***.

The cylinder **12*c* is secured at the lead end thereof to a flat ring 30 which in cooperation with a flat ring 31 and bolt 32 clamps a rubber seal ring 34 in place. The seal ring 34 provides a seal against the pipe 10 immediately trailing the cleaning portions of the system (not shown). The seal ring 34 serves to keep the area in which the flood shoe 12 operates free from debris and thus assures a uniform application of coating material to the surface of the pipe 10**.

The flood shoe 12 may be moved along pipeline 10 by conventional transport means such as the transport portion of the Model CPT machine 48–56 above identified.

The trailing end of the cylinder 12*c* has clamped thereto a conically shaped section wiper unit 40 made of material such as carpeting. The wiping unit 40 comprises a cylindrical portion 41, a conical portion 42 and a final or trailing cylindrical portion 43. The cylindrical portion 41 is clamped to the trailing edge of the cylinder 12*c* by a clamp ring 44. The trailing section 43 is clamped to the surface of the pipeline 10 by a band of webbing 45. Webbing 45 is adjusted in tension so that the thickness of the coating of the primer can be regulated. Excess coating will be wiped off because of the pressure applied by webbing 45. The excess coating material then accumulates in the cavity formed by the cylinder 12*c* and the wiper unit 40. The surplus material will flow downward through ports 12*m* and 12*n* and then by way of conduits 46 and 20 into the reclamation tank 22 (not shown in FIG. 2).

Recapping, it will now be seen that a supply of priming material is maintained in the cavity 12*k* formed between the sets of brushes 12*a* and 12*f* and inside the cylinder 12*c*. The brushes and all portions of the system having any contact with the pipe are non-metallic. The brushes 12*a* and 12*f* are polypropylene fibers or the like. The washers 12*d* and 34 are rubber. The trailing wiper unit 40 is of fabric, therefore, there is avoided the presence of contact with the pipe of any material that would tend to spark and thereby initiate combustion. The unit is completely enclosed thus minimizing the possibility of fire, minimizing evaporation and minimizing outside contamination. There is no spray of atomized primer as in spray systems thereby minimizing the leaking and blowing as well as contamination as in systems heretofor used where open pans and open pipe surfaces have been characteristic.

Figure 3:
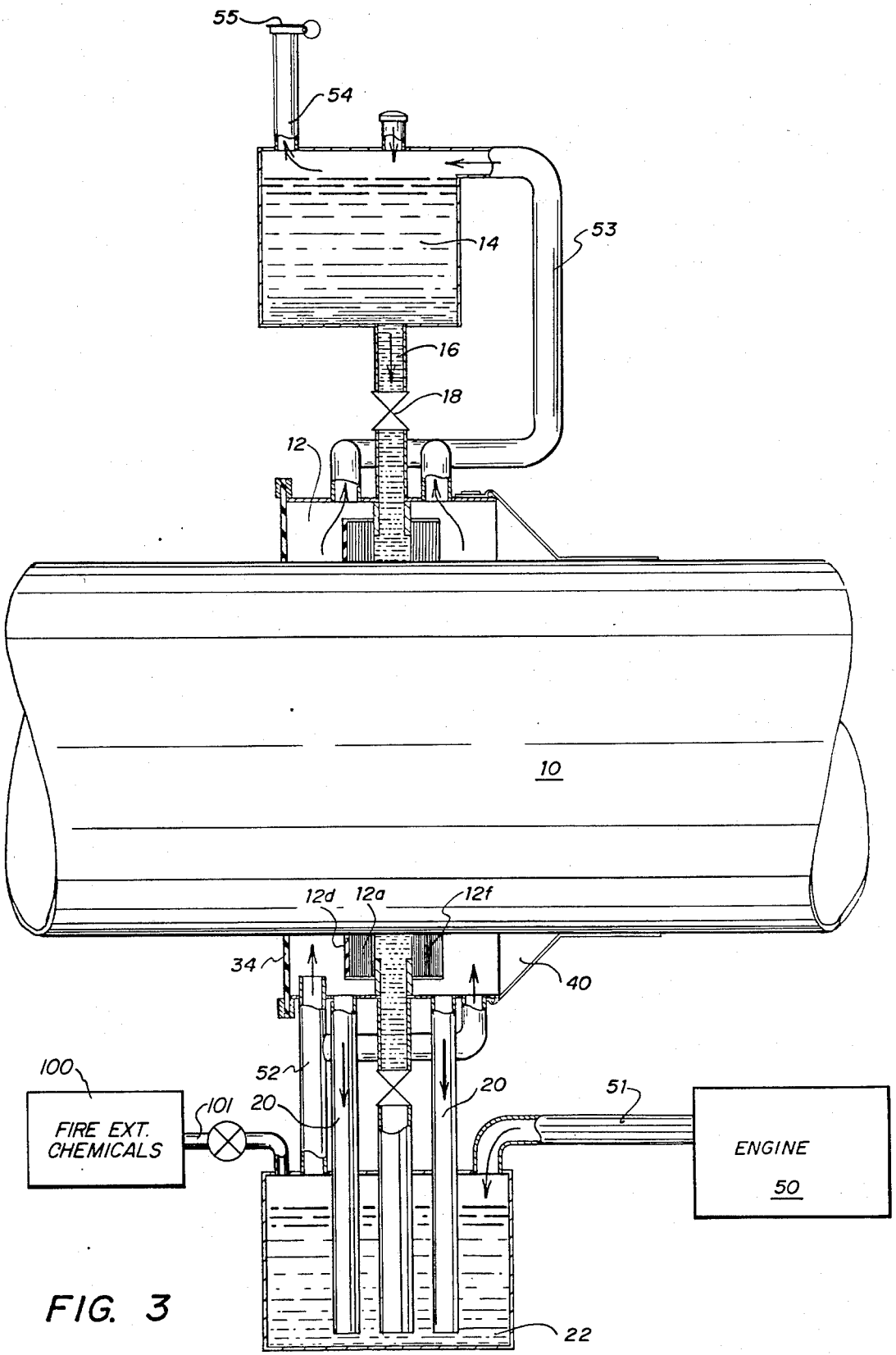
FIG. 3 is a view of the system generally along the same line as in FIG. 2.
Figure 4:
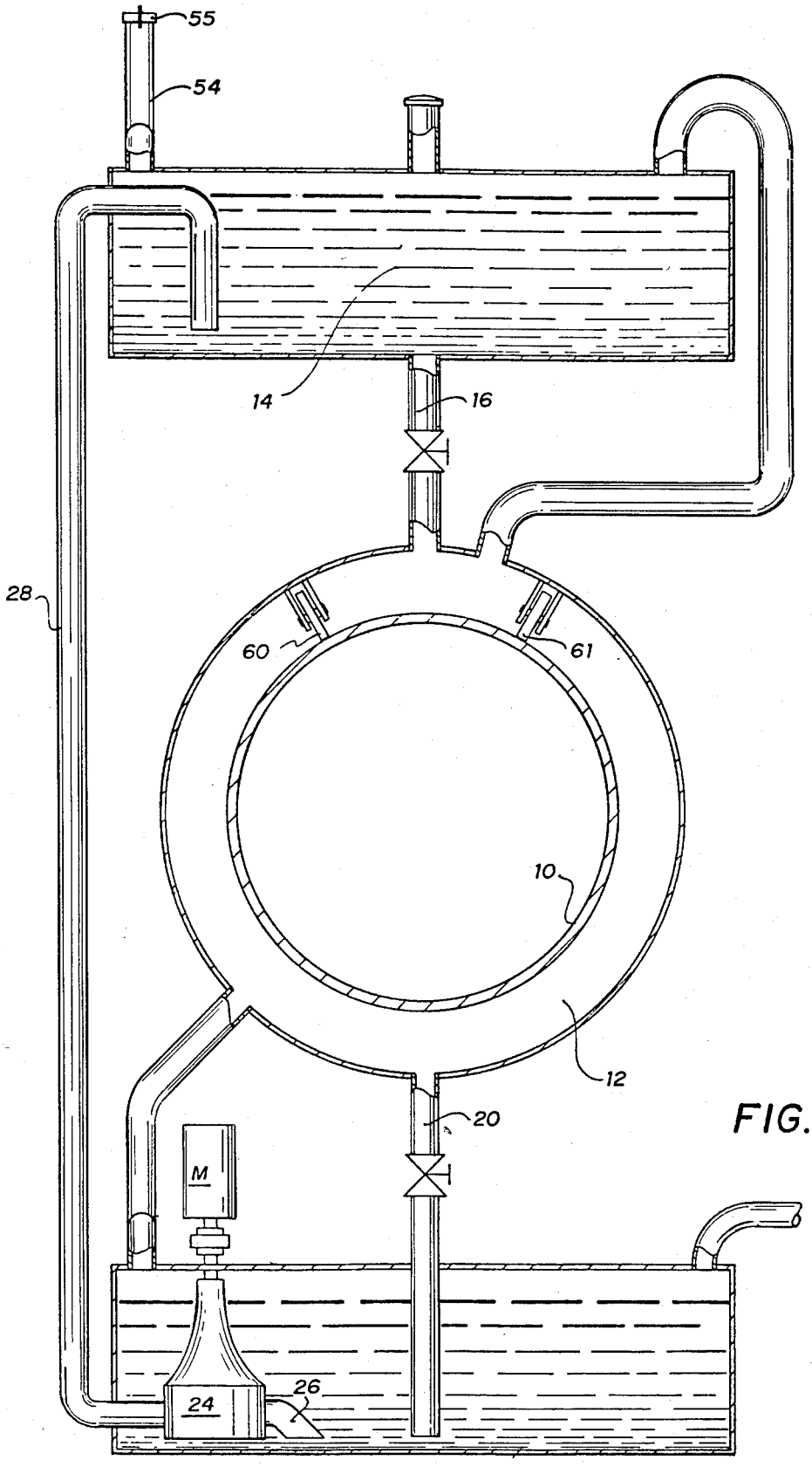
FIG. 4 is a transverse sectional view of the system of FIG. 3.

In order to further minimize the possibility of fire, provision has been made for scavenging any oxygen present inside the flood shoe 12 and surrounding cavity. One embodiment of such a system is shown in FIGS. 3 and 4. In this system, an internal combustion engine is provided to drive the cleaning-priming-tape wrapping machines of the type above-identified. The flood shoe 12 is aligned with and supported on pipeline 10 by rollers 60 and 61, FIG. 4. In FIG. 3 the drive engine has been illustrated by the unit 50. A portion of the exhaust from the engine is conveyed by way of an exhaust line 51 into the upper portion of the reclamation tank 22. A flow channel 52 then leads from the upper portion of the reclamation tank 22 into the flood shoe. As illustrated, the conduit 52 passes through the surface of the cylinder 12*c*.

A conduit 53 then leads from the upper portion of the flood shoe 12 into the top of the surge tank 14. An exhaust conduit 54 then leads through flapper valve 55 to exhaust to the atmosphere. By this means the combustion products from the engine 50 are swept through the storage tanks and flood shoe area to displace most of the oxygen and in so doing substantially reduce the flammability of the gaseous environment.

If desired, the system may further be embellished by the addition of units to introduce fire extinguishing chemicals such as carbon dioxide gas. A chemical from such a source 100 introduced by way of path 101 may provide an added element of safety and would be brought into use in event fire is started through some act or instrumentality independent of the system shown.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is:

1. A method of applying a primer coating to a pipeline, comprising the steps of:

moving a cylindrical body of liquid primer along said pipeline while contacting said pipeline fore and aft of said body by non-metallic bristle rings which serve to confine and define said body;

wiping to a predetermined thickness the primer on said pipe aft of said rings while moving excess primer forward for collection and recirculation to said body; and establishing an inert gas flow in the zones occupied by said primer.

2. A method for applying a coat of paint to the exterior surface of a pipe, comprising the steps of:

(a) contacting the periphery of said pipe with a pair of coaxial spreader units spaced apart along said pipe to form an annular cavity encircling said pipe, (b) loading said paint into said cavity, (c) clamping a wiper unit about the periphery of said pipe in trailing relation to said cavity to wipe surplus paint from said pipe and to form together with a first of said spreader units a first enclosure adjacent said cavity, (d) recovering surplus paint from ahead of said wiper unit and collecting said surplus paint in a reclamation reservoir, (e) pumping said surplus paint from said reservoir into the top of said cavity, (f) contacting a flexible closure member about the periphery of said pipe in leading relation to said cavity to form together with a second of said spreader units a second enclosure adjacent said cavity, and (g) flooding said first and said second enclosures with a substantially oxygen-free gas.

3. A method for applying a coat of paint to the exterior surface of a pipe as recited in claim 2 wherein the step of loading said paint comprises storing said paint in a storage reservoir located superior to said cavity and providing gravity flow of said paint into said cavity.

4. A method for applying a coat of paint to the exterior surface of a pipe as recited in claim 3 further including the step of flooding said reservoirs with a substantially oxygen-free gas.

5. Apparatus for applying a primer coat material to a pipe from a supply comprising:

a housing movable along and encircling said pipe and including a reclamation reservoir, said housing having a leading end with an opening larger than the pipe and further including a trailing end.

a pair of non-metallic coaxial spreader units supported within the housing, spaced apart, and in contact with the pipe to form a closed annular cavity encircling the pipe, means to load liquid primer into said cavity to wet the entire surface of said pipe between the spreader units, a non-metallic sealing washer attached to and extending from the leading end of the housing and in wiping contact with the pipe, wiper means attached to the trailing end of the housing, spaced from and in a trailing relationship to the cavity, said wiper means including a non-metallic wiping material in contact with the pipe, said wiper means further including means between the wiping material and the trailing end to return surplus primer coating material to the reclamation reservoir, a pump having an input connected to the reservoir and an output opening into the supply, said pump delivering surplus primer material for flow into the cavity, and means for purging the reservoir, housing, cavity and supply for scavenging oxygen from the apparatus to reduce the flammability of a gaseous environment.

6. In a pipe treating machine, a system for applying a primer coat to a pipe which comprises:

structure movable along and encircling said pipe including a pair of non-metallic coaxial spreader units mounted therein and spaced apart along said pipe to form a closed annular cavity encircling said pipe, means to load liquid primer into said cavity to wet the entire surface of said pipe between said spreader units, non-metallic closure means contiguous said pipe, supported in said structure in a leading relation to said cavity, and forming together with said spreader units an enclosure adjacent to and leading said cavity, wiper means including a non-metallic wiper unit attached to said structure and in wiping contact with said pipe in trailing relation to said cavity and forming together with said spreader units an enclosure adjacent to and trailing said cavity, a reclamation reservoir to receive flow of surplus primer from ahead of said wiper unit, said wiper means further including means for returning surplus primer to said reclamation reservoir, a pump to deliver said surplus primer for flow into the top of said cavity, and means for flooding said enclosures with a substantially oxygen-free gas.

7. A system as recited in claim 6 wherein said coaxial spreader unit comprises a plurality of fiber brushes.

8. A system as recited in claim 6 wherein said means to load liquid primer comprises a storage reservoir located superior to said cavity providing gravity flow of said primer.

9. A system as recited in claim 6 wherein said wiper unit comprises:

(a) a conical fabric member enclosing said pipe, and (b) means for adjusting the pressure between said fabric member and said pipe.

10. A system as recited in claim 6 including means for aligning said spreader units in relation to said pipe.

* * * * *